United States Patent [19]

Wagner

[11] 4,135,588

[45] Jan. 23, 1979

[54] BORING AND COMPACTING TOOL

[75] Inventor: Robert L. Wagner, Grand Rapids, Mich.

[73] Assignee: Schreves, Inc., Grand Rapids, Mich.

[21] Appl. No.: 853,266

[22] Filed: Nov. 21, 1977

[51] Int. Cl.[2] ..... E21B 11/02

[52] U.S. Cl. ..... 175/19; 175/62; 175/385; 175/394

[58] Field of Search ..... 175/19, 62, 385, 386, 175/323, 401, 408, 409, 394

[56] References Cited

U.S. PATENT DOCUMENTS

| | | | |
|---|---|---|---|
| 1,547,459 | 7/1925 | Stafford et al. | 175/392 X |
| 1,616,666 | 2/1927 | Nebergall | 175/323 |
| 2,349,033 | 5/1944 | Elliott | 175/394 |
| 2,425,132 | 8/1947 | Stokes | 175/394 |
| 2,558,341 | 6/1951 | Cory et al. | 175/401 |
| 2,565,333 | 8/1951 | Weidman et al. | 175/395 |
| 2,673,714 | 3/1954 | Hargrave | 175/394 |
| 2,973,821 | 3/1961 | Stihl | 175/388 |
| 2,979,141 | 4/1961 | Kandle | 175/62 X |
| 3,554,303 | 1/1971 | Zajkowski | 175/19 |
| 3,708,023 | 1/1973 | Nazarov et al. | 175/19 |

FOREIGN PATENT DOCUMENTS

| | | | |
|---|---|---|---|
| 693404 | 9/1964 | Canada | 175/19 |

*Primary Examiner*—Ernest R. Purser
*Assistant Examiner*—Richard E. Favreau
*Attorney, Agent, or Firm*—McGarry & Waters

[57] ABSTRACT

The boring and compacting tool comprising an elongated shaft having a front conical section and a rear cylindrical portion. A front helical spring is wrapped about the conical section and attached thereto at the ends thereof. A cutting head is threaded onto a front end of the conical portion. A distinct annular cylindrical collar fits about the cylindrical section of the shaft and is removably secured thereto. A rear helical spring is fitted about the conical portion of the shaft behind the collar and is threaded about the shaft in the same direction as the front helical spring.

5 Claims, 7 Drawing Figures

BORING AND COMPACTING TOOL

BACKGROUND OF THE INVENTION

1. Field of the Invention

This invention relates to a boring apparatus and more particularly to a boring apparatus for horizontally boring small diameter holes for cables or other utility lines under a street or sidewalk.

2. Description of the Prior Art

Augers are most commonly used to bore small diameter holes under streets or under sidewalks where it would be uneconomical or unfeasible to create a trench. The holes are made for the continuous laying of utility lines.

A commercially available tool for drilling such holes comprises an auger secured to the end of a bore line which is rotated by a motor. The bore line is most commonly set into the side of the earth so that the auger may bore a hole horizontally through the earth.

The auger is a one-piece metal tool having a small cutting edge at the front thereof. A conical-shaped threaded section extends from the cutting edge to an expander. The threaded section is radially larger toward the expander. The expander is a cylindrical surface of a diameter at least as great as that of the adjacent threaded section.

In addition, some conventional one-piece augers have an integrally-formed threaded section located behind the expander.

The cutting bit is used to cut through earth, such as clay or soil, and to create a small hole so the threaded section can engage the earth around the hole and thread its way into the earth like a corkscrew. As the auger threads through the earth, the threads create a continually larger diameter hole until the expander passes through the hole, thereby compacting the earth and expanding the hole. No earth is removed from the hole, but the earth is simply compressed about the hole. The rear-threaded section is used to thread the auger out of the hole if any cave-ins occur within the hole.

U.S. Pat. No. 2,979,141 issued to Kandle on Apr. 11, 1961, discloses a one-piece auger with a front cutting edge, a tapered screw flight for threading itself into the bored hole, and a cylindrical portion located behind the threads for compressing the sides of the hole as it passes therethrough. Behind the expander are means to connect the auger to the rotating drive shaft sections.

U.S. Pat. No. 3,550,698 issued to Pauley on Dec. 29, 1970, discloses an auger with a cutting head and integrally-formed helical screw flight which threads the auger forward through the earth.

Cutting edges and screw flights are found not only on augers, but also on drill bits which cut into hard rock. The cutting bit is braced onto a cylindrical shaft. The cutting bit has a radial length equal to the diameter of the cut hole. The screw flights are sometimes made from a resilient material which is threaded about the shaft such that when the shaft rotates, the threads conduct dust and dirt outwardly up and out of the drilled hole.

The problem encountered with augers are that one or more sections of the auger are liable to wear out or break through the repetitive rotation through earth, sand, and rock. Sometimes the cutting bit may wear out first, or the threads or the expander may wear out first, depending upon the speed of the rotation, the kind of soil which is being bored, and the number of cave-ins and obstacles met while the auger is boring through the earth. The relative hardness of the sections of the auger is also an important factor in determining which section wears out the fastest. When one of the sections becomes worn, the whole auger needs to be replaced.

In addition, the auger is a relatively complicated shaped tool with many curves and bends which militates against the use of hardened steel or other harder metals for the augers. It is well known that the more intricately shaped tools must be made from softer metals which can be machined or cast. Harder metals become economically unfeasible for use in augers since the machining of harder metals wear out the machining tools and equipment. As a consequence, the augers must be made from softer metals and are subject to more wear and tear and must be replaced more often than desirable.

SUMMARY OF THE INVENTION

According to the invention, an auger for use with a rotating bore line has a front cutting edge, a screw flight extending rearwardly from the cutting edge and spirally disposed about the rotational axis of the auger. The rear end of the auger has means for connecting the auger to the bore line. An expander section is located behind the screw flight.

The expander section has a separate expander axially secured to the auger behind the threaded section. Means removably secure the separate expander to the auger. The securing means is one specific embodiment comprises a threaded set screw engaging the internal threads of a hole passing through the expander to engage an indentation or recess in the auger.

Preferably the auger has a central elongated shaft with the connecting means at a rear portion of the shaft for connecting the shaft to a rotatable bore line to align the axis of the central shaft with the axis of the bore line. The front portion of the shaft has spiral threads which preferably taper to a relatively radially small front end which has a cutting edge.

Further according to the invention, the separate thread means is removably secured to the central shaft. In one specific embodiment, the thread means includes a helical tapered coil wrapped about a front conical portion of the central shaft and secured thereto to prevent unlimited rotation of the thread means about the shaft. The coil is made from spring steel.

Preferably reusable means secure the helical spring to the shaft such that the means can secure a replacement helical spring to the shaft.

Preferably the expander is an annular collar with a central bore through which a cylindrical rear portion of the central shaft fits.

Further according to the invention, a separate cutting bit is mechanically and removably secured to the front end of the threaded section. It is preferable that the separate cutting bit is secured to the front end of the conical section of the central shaft. In one specific embodiment, the cutting bit comprises a cutting edge secured to a cap. The cap has an internal bore such that the cap axially fits over the front end of the shaft. Means secure the cap to the shaft in a fixed position. Preferably the internal bore is threaded. The threaded bore engages a complementary threaded section at the front tip of the conical portion of the central shaft. Alternatively, or in addition to the threads, a set screw engages an internally threaded hole through the cap section and abuts the central shaft to fixedly secure the cap onto the shaft.

In one embodiment of the invention, the auger includes a second rear-threaded section of the central shaft located to the rear of the annular collar. The rear-thread section has a radial outer diameter no larger than the outer diameter of the collar. The threaded rear section is spiraled in the same direction as the front-threaded section such that when the rotation of the auger is reversed and a cave in has occurred in the hole, the rear-threaded section can thread the bore out from the hole through the collapsed earth. It is desirable that the rear-threaded section is a second helical coil wrapped about a rear conical portion of the central shaft to the rear of the collar and secured to the shaft to prevent unlimited axial rotation with respect thereto. The rear coil is also made from spring steel.

BRIEF DESCRIPTION OF THE DRAWINGS

Reference will now be made to the drawings in which.

DETAILED DESCRIPTION OF THE PREFERRED EMBODIMENT

Figure 1:
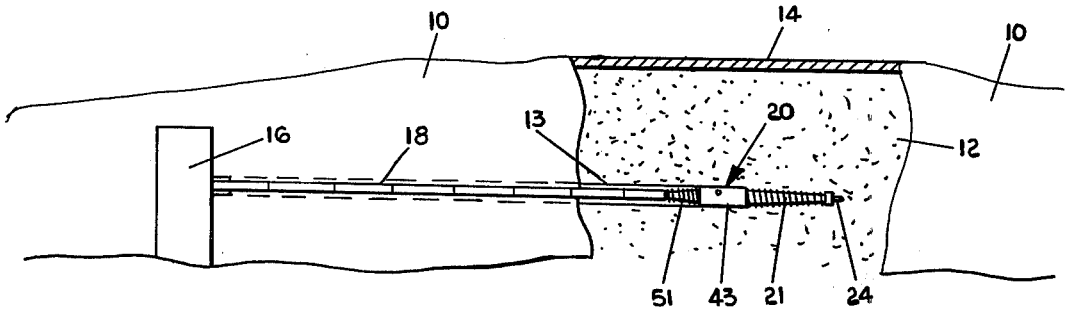
FIG. 1 is a side elevational view of an auger connected to a rotating bore line.

Referring particularly to FIG. 1, an auger 20 has a cutting edge 22 attached to the front end thereof. Behind the cutting edge is a threaded section 21 and a cylindrical expander section 43 and a rear-threaded section 51. The rear of the auger 20 is connected to a bore line 18 which is rotated by a motor 16. The auger 20 is used to drill a horizontal hole 13 through earth 12 which lies under a street or sidewalk 14 or similar obstruction where it is uneconomical to dig a trench.

Figure 2:
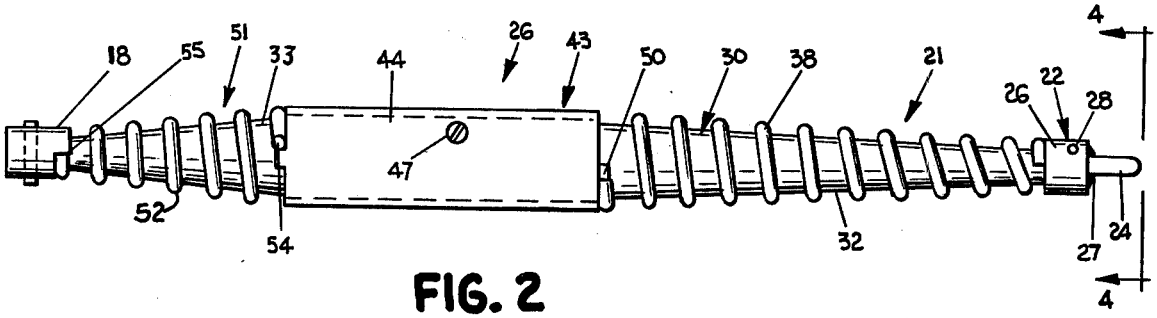
FIG. 2 is an enlarged side elevational view of the auger as shown in FIG. 1.
Figure 3:
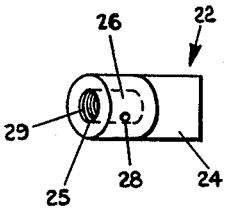
FIG. 3 is a rear perspective view of the cutting bit shown in FIG. 2.

Referring particularly to FIGS. 2 and 3, the cutting edge 22 has a cutting edge 24 made from hardened heat-treated steel and welded onto a cap 26 at weld 27. The cap 26 has a hollow bore 25, internal threads 29 and a threaded hole 28 at its side surface. The internal threads 29 engage complementary external threads 35 on a front threaded end 34 of a central shaft 30 as shown in FIG. 5.

Figure 5:
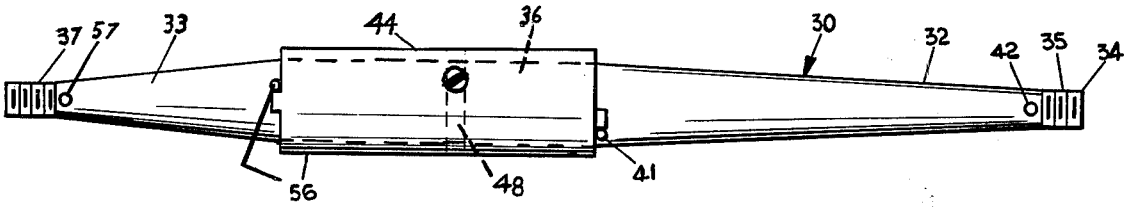
FIG. 5 is a side elevational view of the central shaft shown in FIG. 2.

As shown in FIG. 5, the shaft 30 has a front conical section 32 and a cylindrical expander portion 36 and a conical rear portion 33. At the rear end of the conical rear portion 33 is a rear connector 37 for connection to the bore line 18 in a conventional fashion. Various tapped holes are in the central shaft 30. A front tapped hole 42 is on the conical section 32 near the threaded end 34 and another tapped hole 41 is at the rear portion of the conical section 32. A tapped hole 48 is placed in central cylindrical portion 36 and tapped holes 56 and 57 are on the conical section 33 of the central shaft 30.

Figure 6:
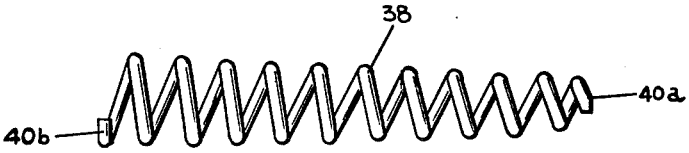
FIG. 6 is a side elevational view of the helical spring as shown in FIG. 2.

Referring now to FIGS. 2 and 6, the conical threaded section 21 is formed by a thick but resilient helical spring 38 wrapped about the front conical section 32 of the central shaft 30. As shown in FIG. 6, helical spring 38, made from spring steel, is conical in shape to correspond with the conical shape of section 32. The front end 40*a* of the conical-shaped helical spring 38 is bent radially inward. The rear end 40*b* is also bent radially inward. The ends 40*a* and 40*b* protrude into the tapped holes 42 and 41, respectively.

Figure 7:
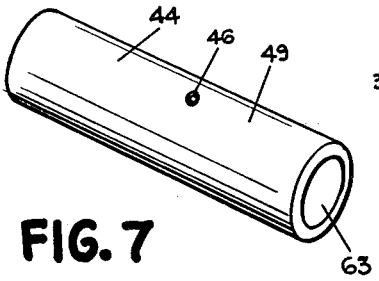
FIG. 7 is a perspective view of the annular collar shown in FIG. 2.

Referring now to FIGS. 2 and 7, expander section 43 includes an annular collar 44 made from hardened steel with a threaded aperture 46 through its annular surface. The collar 44 has a cylindrical outer surface 49 and an internal opening 63 having a diameter equal to the diameter of the cylindrical portion 36 of the central shaft 30. The thickness of the annular collar is equal to the diameter of the metal wire of the helical spring 38. The collar fits over the cylindrical portion 36 and a set screw 47 engages the threaded aperture 46 and protrudes into the tapped hole 48 as shown in FIG. 5. The helical spring is spiraled in the same direction as the threads 35 such that the auger is rotated, the cutting head is maintained on the shaft 30 and the helical spring 38 threads into the earth.

Figure 4:
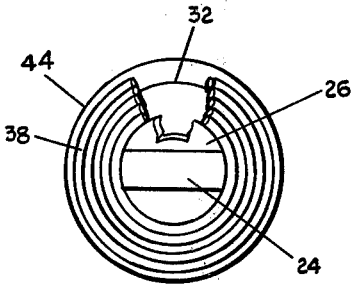
FIG. 4 is an enlarged, partially broken front elevational view taken along lines 4—4 in FIG. 2.

As shown in FIGS. 2 and 4, the outer diameter of the cutting head 22 is relatively smaller than the diameter of the rear-end of the conical section of the shaft. The helical spring 38 is wrapped about the conical section about ten times so that each successive coil is slightly greater in diameter than the previous front coil. The rear of the helical spring 38 has an outer diameter substantially equal to the outer diameter of the collar 44. The inner diameter of the rear end of the helical spring 38 is substantially equal to the inner diameter of the collar.

As shown in FIG. 2, to the rear of the collar, the rear thread section 51 is formed by a helical spring 52 axially mounted about the conical section 33 of shaft 30. The spring 52 is made from spring steel. The spring has the same spiral direction as the front spring 38. The helical spring 52 has a front end 54 and a rear end 55 which are bent radially inward and protrude into holes 56 and 57 respectively in shaft 30. The outer diameter of the front end of the rear helical spring 52 is no greater than the outer diameter of collar 44. The helical spring 52 is conically shaped to conform to the conical shape of the rear section 33.

The operation of the auger will now be described with reference to one point along the hole 13. The cutting head 22 has its cutting bit 24 cut into the earth 12. The conical threaded section 31 threads into the earth and forces the bit to cut further into the earth. The tapered conical shape of the threaded section gradually expands the hole as it threads its way therethrough. The expander section 43 compacts the earth about the hole to form the expanded hole. The operation of the auger is the same continuously through the whole length of the bored hole 13.

The rear threaded section 51 is a safety feature which helps retrieve the auger in case there is a cave-in of the hole 13 behind the auger. When the auger reverses its rotation, the spring 52 threads the auger out from the hole through the cave-in and the expander section 43 recompacts the earth to form a continuous bored hole 13.

Due to the extreme wear and tear encountered by the rotating auger, the parts eventually wear out. The drill bit often encounters rock or hardened earth and the threaded section also receives wear. The collar, in rotating and compacting the earth, builds up extreme heat and is subject to stresses and wear. When one or more parts become worn past the point of use, they can be removed from the central shaft and replaced by a fresh, new replacement. The conical head 22 can be removed by loosening set screw 31 and rotating the cap off the threaded end 34. The spring 38 can be removed by merely flexing the ends so that ends 40a and 40b disengage from the holes 42 and 41 so the spring 38 slides off the conical section 38. The holes 42 and 41 can then receive and secure a replacement spring. The collar 44 can be removed by loosening set screw 47 to disengage from tap hole 48 such that the collar 44 can slide out over the conical portion 32 and past front end 34 of the shaft. Set screw 47 and hole 48 can be reused to secure a replacement collar to the shaft. The rear spring 52 can also be removed by outwardly flexing its ends 54 and 55 to disengage from the holes 56 and 57 so the spring 52 can slide over the shaft. All the parts can be removed from the front without disengaging the central shaft 30 from the bore line 18.

In addition, each separate component, namely the central shaft, the helical springs, the collar and the cap, has a relatively simple shape compared to the conventional one-piece auger as a whole. The simpler shapes allow the parts to be manufactured from harder and more durable metals by forging or other manufacturing techniques which avoid machining.

Further, the springs 38 and 52 flex when they encounter a hard rock or different stresses and forces. The springs can flex and give with the forces and spring back into position once those forces are relieved. The flexibility of the threaded section reduces the possibility of breakage of the threads.

This invention allows for more economical boring since replacement parts are less often needed and, secondly, when one part becomes worn, only that worn part need be replaced.

Reasonable variation and modification are possible within the scope of the foregoing disclosure and drawings without departing from the spirit of the invention which is defined by the appended claims.

The embodiments of the invention in which an exclusive property or privilege is claimed are defined as follows:

1. In an auger for use with a rotating bore line for boring a hole through the earth; and having means for connecting the auger to the bore line; the front end of the auger is tapered and has a cutting edge for cutting into the earth; a tapered threaded flight spirally disposed about the rotational axis of the auger behind the cutting edge for threading the auger through the earth, and a cylindrical expander section behind the threaded flight for compacting the earth about the hole to form an expanded hole;

the improvement comprising:

an elongated shaft having an elongated tapering front end extending from a central portion;

the expander section includes a separate annular collar with a cylindrical outer surface and a central axial opening positioned on the central portion of the elongated shaft for axial movement with respect thereto;

means for removably securing the collar to the central portion of the shaft to tightly retain the collar in fixed position on the shaft;

the cutting edge comprises a separate cutting member including the cutting edge, having a smaller diameter than that of the cylindrical outer surface of the annular collar and mounted to the front end of the shaft;

means for removably securing the separate cutting member to the front end of the shaft to tightly retain the cutting member on the shaft; and the threaded flight comprises a tapered helical spring extending from the separate cutting member at the front of the shaft to the collar at the central portion of the shaft, the diameter of the front end of the spring being substantially equal to the diameter of the cutting member and the diameter of the rear portion of the spring being substantially equal to the outer surface of the collar;

whereby the collar, helical spring and cylindrical cutting member are easily replaceable.

2. An auger as defined in claim 1 wherein the separate cutting member includes a cutting bit rigidly secured to a tip of a cap, the cap has an internal bore;

a front end of the conical section of the shaft fits within the internal bore; and means for removably securing the cutting head to the auger.

3. An auger as defined in claim 1 wherein the helical spring is made from spring steel.

4. In an auger for use with a rotating bore line for boring a hole through the earth and having means for connecting the auger to the bore line, the front end of the auger is tapered and has a cutting edge for cutting into the earth, a tapered, threaded flight spirally disposed about the rotational axis of the auger behind the cutting edge for threading the auger through the earth, and a cylindrical expander section behind the threaded flight for compacting the earth about the hole to form an expanded hole, the improvement comprising:

an elongated shaft having an elongated tapering front end extending from a central portion and a rear portion extending rearwardly from the shaft;

the expander section includes a separate annular collar with a cylindrical outer surface and a central axial opening positioned on the central portion of the elongated shaft for axial movement with respect thereto;

means for removably securing the collar to the central portion of the shaft to tightly retain the collar in fixed position on the shaft;

the threaded flight comprises a tapered helical spring extending from the collar to the front end of the shaft;

a rear helical spring axially wrapped around the rear portion of the shaft behind the collar;

the outer diameter of the collar being at least as large as the diameter of the rear helical spring adjacent the collar; and the rear helical spring being spiralled in the same direction as the helical spring forming the threaded flight.

5. An auger as defined in claim 4 wherein the rear portion of the elongated shaft is tapered to a rear end thereof; the rear helical spring is correspondingly conical in shape and tapered toward its rear end such that the spring fits over the rear tapered section of the shaft.

* * * * *